US006176762B1

(12) United States Patent
Shimizu et al.

(10) Patent No.: US 6,176,762 B1
(45) Date of Patent: Jan. 23, 2001

(54) METHOD OF CUTTING A CERAMIC BASE PLATE

(75) Inventors: Kazutoyo Shimizu, Osaka; Naoyuki Okamoto, Ibaraki; Makoto Fukuda, Takatsuki, all of (JP)

(73) Assignee: Sumitomo Special Metals Co., Ltd., Osaka (JP)

( * ) Notice: Under 35 U.S.C. 154(b), the term of this patent shall be extended for 0 days.

(21) Appl. No.: 09/122,715

(22) Filed: Jul. 27, 1998

(30) Foreign Application Priority Data

Jul. 31, 1997 (JP) ..... 9-220828

(51) Int. Cl.[7] ..... B24B 1/00

(52) U.S. Cl. ..... 451/28; 451/41; 451/56; 125/2; 125/11.01

(58) Field of Search ..... 451/41, 56, 72; 125/2, 11.01

*Primary Examiner*—Timothy V. Eley
*Assistant Examiner*—Willie Berry, Jr.
(74) *Attorney, Agent, or Firm*—Watson Cole Grindle Watson, P.L.L.C

(57) ABSTRACT

A method for cutting a ceramic base plate with which the process efficiency is improved, a stable cutting resistance can be maintained during the cutting process, and excellent process precision can be achieved, a wherein supporting plate which is used for the cutting of the ceramic base plate has a structure of a sealed surface layer which has been impregnated with glass components into both surfaces of the sintered porous alumina body. The supporting plate is fixed on a stage of a cutting machine along a forward direction of the rotary cutting blade through a vacuum-absorption and the ceramic base plate as a work-piece is wax-bonded to the supporting plate. While rotating the rotary cutting blade, first of all, the supporting plate is cut so that the blade is dressed/sharpened with the sintered porous alumina body. In the next step, the ceramic base plate is cut and the cutting whetstone blade cuts the supporting plate to a certain depth, so that the rotary cutting blade will contact to the ceramic base plate, then sintered porous alumina body of the supporting plate. As a result, the dressing/sharpening the blade can always be performed, and at the same time the ceramic base plate can be cut while keeping the cutting resistance at low level.

11 Claims, 2 Drawing Sheets

METHOD OF CUTTING A CERAMIC BASE PLATE

FIELD OF THE INVENTION

The present invention directly relates to a production method, through which, in the cutting process of the ceramic base plate which is used for the magnetic head, a whetstone can be dressed and sharpened while the whetstone being used for machining process and said ceramic base plate can be cut simultaneously, so that the cutting efficiency can be improved. The present invention also relates directly to a supporting plate which can support a work piece to be machined, exhibits an excellent heat resistance, can be fixed by a vacuum-absorption onto the cutting stage, and therefore be usable for the process of said ceramic base plate.

DESCRIPTION OF THE PRIOR ART

In the magnetic head which is manufactured through the precise machining, $Al_2O_3$—TiC system materials are dominantly utilized as magnetic head base plate materials while $ZrO_2$ system or SiC system materials have been preferably selected as materials for the ceramic base plates. In general, the film thickness of these oxide plates is ranged from 1 mm to 3 mm. Responding to current demands on a narrow-gapping and a miniaturization of magnetic heads, further precise process and higher quality control become to be indispensable tasks.

Accordingly, a rotary blade for sufficient cutting operation used for the precise process has a trend in such a way that the blade thickness of the whetstone being provided on the outer periphery of said rotary blade will be further thinner and the rigidity of the whetstone blade will be much lower. Since when the cutting resistance during the cutting operation using the whetstone blade becomes higher, the bending toward to the axial direction will take place and preciseness and quality of the cut surfaces might be adversely affected; therefore it is indispensable to keep the lower level of the cutting resistance for the whetstone blade in order to unsure the constant precision process.

The whetstone blade for the rotary blades as described above is normally fabricated by combining the diamond abrasive grains with polymeric resins or metals. In order to keep the low level of the cutting resistance of said whetstone blade, the whetstone blade is normally sharpened and dressed.

Namely, as for the conventional method of cutting the ceramic base plate as seen in FIG. 2, a supporting plate 2 made of a ceramic material is fixed through the vacuum-absorption mechanism onto the stage 1 of the cutting machine. Onto this supporting plate 2, the ceramic base plate 3 (which is a work-piece to be machined) and dressing plate 4 (which is made of a sintered porous alumina body and used for dressing/sharpening the blade) are placed in line and parallel to the rotary blade 5 and bonded with the wax. The dressing plate 4 is machined by a rotary cutting blade 5. After the dressing/sharpening the whetstone blade is completed, the ceramic base plate 3 is tranceferred to the cutting operation. After cutting it for predetermined cycles, the dressing/sharpening operation will be repeated.

By the conventional cutting operation for the ceramic base plates, once the cutting resistance of the rotary blade 5 becomes gradually larger during the cutting process, the rotary blade 5 is dressed and sharpened by the dressing plate 4. After the dressing operation is completed, the cutting process of the ceramic base plate 3 is repeated. The dressing of the whetstone blade is performed whenever needed between the cutting operations of the ceramic base plate.

However, the dressing effect on the rotary blade is gradually deteriorated during the cutting the ceramic base plate 3, and the cutting resistance will become higher, so that the stable cutting resistance can not be maintained any more. Furthermore, the conventional method, as seen in FIG. 2, has another technical problem such as that the transferring locus of the rotary blade 5 is U-shaped and such movement is repeated many times, so that the cutting efficiency will be also deteriorated.

Accordingly, as seen in FIG. 3, the dressing plate 4 and the ceramic base plate 3 are arranged and wax-bonded on the supporting plate 2 of the stage of the cutting machine on a line extending along a moving direction of the rotary cutting blades 5. As a result, the whetstone blade can be dressed and sharpened in-process manner in order to reduce the cutting resistance thereof and to machine the ceramic base plate 3.

By the aforementioned method, although the dressing effect and the process efficiency can be expected to some extent, the dimension and size of the dressing plate 4 are needed to be designed appropriately in corresponding to the dimension and shape of the ceramic base plate 3 as a work-piece. Moreover, the operator should determine the optimum conditions for the stable zone in terms of the cutting resistance of the rotary blade 5 and an extensive experience is required to have a proper arranging the dressing plate 4 and ceramic base plate 5 onto the supporting plate 2 of the stage 1. These tasks require a certain period of time to become a skill operator. Furthermore, the conventional method possesses another technical drawback such that for fixing the dressing plate 4, said wax component might be penetrated into the porous dressing plate.

OBJECTIVE OF THE INVENTION

It is an objective of the present invention to provide a production method through which the process efficiency of the conventional type of the ceramic base plate can be improved, the stable cutting resistance can be obtained during the cutting process, and excellent production precision can be achieved.

It is another objective of the present invention to provide a supporting plate for cutting the ceramic base plate and a production method by which the wax-bonding can be achieved with the ceramic base plate as a work-piece to be machined, a firmly setting through the vacuum-absorption to the stage of the cutting machine, and the dressing of the whetstone blade and the cutting the ceramic base plate can be operated at the same time, so that a stable cutting resistance can be maintained and excellent production efficiency can be achieved.

SUMMARY OF THE INVENTION

After the present inventors investigated various methods in order to enhance the process efficiency, to maintain the stable cutting resistance, and to achieve the excellent precision process, it was found that a stable cutting resistance and excellent process efficiency can be obtained by a simultaneous operation of dressing/sharpening the whetstone blade of the rotary blade and cutting the ceramic base plate.

In order to overcome the technical drawbacks associated with the conventional method such as production method of the ceramic base plate and dressing plate as mentioned previously, the material and structure of the supporting plate for the ceramic base plate had been extensively investigated in order to make the wax-bonding possible to the ceramic base plate, to make the fixing through the vacuum-absorption possible to the stage of the cutting machine, and the make the simultaneous operation possible of the dressing the blade and the cutting the ceramic base plate. As a result, a glass is welded on the surface of the dressing plate which is made of sintered porous alumina body to seal both side surfaces of said dressing plate, so that it can serve as both a supporting plate and dressing plate. Furthermore, the ceramic base plate is wax-bonded to the upper surface thereof and the lower surface is fixed to stage of the cutting machine through the vacuum-absorption. Hence, a simultaneous operation of the dressing the blade and cutting the ceramic base plate can be achieved. Furthermore, the stable cutting resistance and excellent process efficiency can also be achieved.

The present inventors have also investigated the structure which can be used for both the supporting plate for the ceramic base plate and the dressing plate. As a result, the following structure was evaluated to be the most promising structure to meet the requirements. Namely, a glass paste with a certain composition is applied on both surfaces of the dressing plate made of sintered porous alumina body. The applied glass paste was further subjected to the heat treatment to melt and adhere to the substrate, so that a certain depth of the porous structure near the surface layer of the sintered alumina body is penetrated with the glass composition. Therefore, the surface layer is sealed with this penetrated glass component. Such both-sided sealing reduced the roughness of the sintered alumina body. As a result, it was found that the thus obtained supporting plate being composed of the sintered porous alumina body with small degree of warping can effectively function as a supporting plate for the work-piece to be machined (in this case, ceramic base plate).

Namely, the present invention is characterized by the fact that the supporting plate for the producing the ceramic base plate is composed of sintered porous alumina body which is sealed on both surfaces with the penetrated glass component with a depth ranging from 50 $\mu$m to 300 $\mu$m underneath the surface. According to the present invention, after the ceramic base plate is adhered to the front surface of said supporting plate and the back surface is fixed to the stage of the cutting machine through the vacuum-absorption, while cutting the ceramic base plate by the rotary blade, the supporting plate is machined down or cut to a certain depth simultaneously. Hence, dressing the whetstone blade of the rotary cutting blade and cutting the work-piece (in this case, ceramic base plate) can be operated at the same time.

The supporting plate used for the producing the ceramic base plate, according to the present invention, is formed with an impregnated layer which is penetrated by the glass component into the sintered porous alumina structure. The process using such a supporting plate for a simultaneous cutting the alumina system base plate which is wax-bonded to the impregnated sealed layer makes the wax-bonding possible to the ceramic base plate and makes the fixing possible through the vacuum-absorption to the stage of the cutting machine. Accordingly, the dressing of the whetstone can be achieved equivalently to or better than the conventional method and the simultaneous cutting the ceramic base plate can be conducted, so that the cutting resistance can be maintained at the lower level. Hence, the process precision and efficiency can be improved remarkably.

BRIEF DESCRIPTION OF THE DRAWINGS

The above and many other objectives, features and advantages of the present invention will be more fully understood from the ensuing detailed description of the preferred embodiment of the invention, which description should be read in conjunction with the accompanying drawings.

DETAILED DESCRIPTION OF PREFERRED EMBODIMENTS

Figure 1:
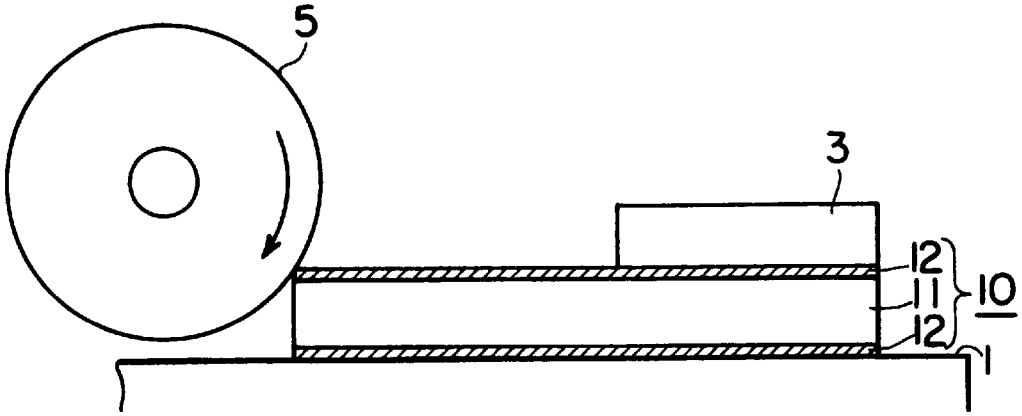
FIG. 1 is a cross-sectional view of the a supporting plate for the ceramic base plate being supported on the stage of the cutting machine demonstrating the process of said ceramic base plate according to the present invention.
Figure 2:
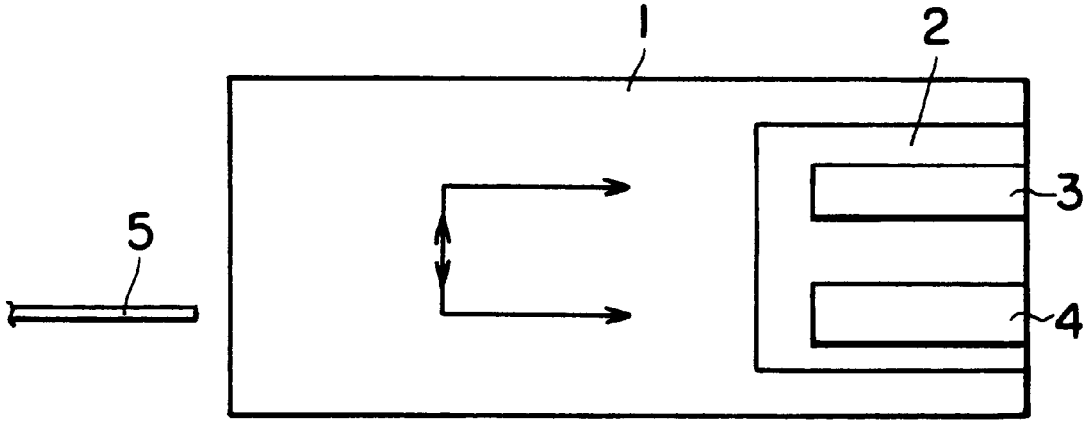
FIG. 2 is an upper portion of the a dressing plate and supporting plate on the stage, demonstrating the conventional method of process of the ceramic base plate.
Figure 3:
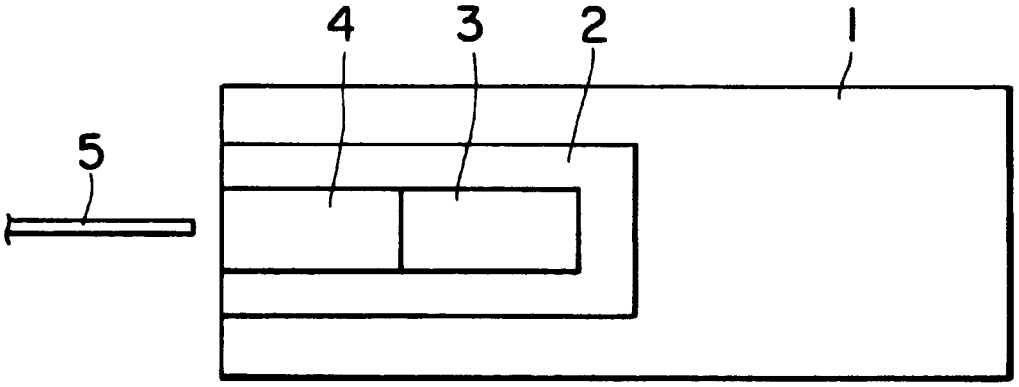
Fig.3 (PRIOR ART)
FIG. 3 is a an upper view of the dressing plate and a supporting plate being provided on the stage, illustrating the another conventional type of the process of the ceramic base plate.

The supporting plate 10 used for the producing the ceramic base plate, as seen in FIG. 1, is prepared as follows. After applying the glass paste with a certain composition onto both surfaces of sintered porous alumina body 11 having the porosity ranging from 30% to 70% which said sintered body is employed as a dressing plate to dress/sharpen the whetstone blade of the rotary cutting blade, said glass is melt and adhered by the heat treatment to impregnate the penetrated glass component into the porous surface with a depth ranging from 50 $\mu$m to 300 $\mu$m, so that impregnated sealed layer 12,12 can be formed.

After the wax-bonding the ceramic base plate 3 to this supporting plate 10, it is firmly positioned through the vacunm-absorption on the stage 1 of the cutting machine along the forward direction of the rotary cutting blade 5.

In FIG. 1, the ceramic base plate 3 is bonded at the one end of the supporting plate 10, so that, while forward rotating the rotary blade 5 from the other end, the sintered porous alumina body of the supporting plate 10 will be firstly dressed, and the ceramic base plate 3 will be cut secondly, and at the same time, said rotary blade 5 will cut the supporting plate 10 to a certain depth. Therefore, the rotary blade 5 during its rotational movement will contact the ceramic base plate 3 and subsequently the sintered porous alumina body of the supporting plate 10, so that the blade can be dressed/sharpened constantly. As a result, the ceramic base plate 4 can be cut while keeping the cutting resistance at the lower level, so that the process precision can be furthermore improved.

According to the present invention, it is preferable to use the alumina raw powder (which is used to fabricate the sintered alumina body for the supporting plate) having an average particle size ranging from 5 $\mu$m to 50 $\mu$m.

Moreover, the reason for defining the porosity ranging from 30% to 70% is based on facts that (1) the porosity less than 30% can not exhibit effective dressing function and makes the lower cutting resistance difficult, and (2) if the porosity exceeds 70%, large pores might be present on the surface layer of the sintered product and glass component will be segregated during the glass impregnation, so that the dressing operation of the whetstone blade will be deteriorated and a stable cutting resistance can not be maintained.

Furthermore, for the supporting plate for the producing the ceramic base plate, when the depth of the impregnated layer which is penetrated with the molten glass component on both sides of the sintered porous alumina body exceeds 300 $\mu$m, the dressing/sharpening effect can not be obtained if the cutting depth of the whetstone blade is not deeper than the impregnated thickness of the glass penetrated layer. For example, in the case when the ceramic base plate with a thickness of 2 mm is needed to be cut completely, if the glass penetrated layer has a depth deeper than 300 μm on both sides of the supporting plate, the contact surface area between the whetstone blade and un-dressable glass impregnated layer will become to be larger, so that the cutting resistance of the whetstone blade will increase. This situation is not favorable.

Furthermore, on the other hand, if the impregnated layer of the glass component has a thickness less than 50 μm, there could be substantially some area which might be impregnated with the glass component. Hence, it would be impossible to fix it under the vacuum-absorption to the stage of the cutting machine. Accordingly, it is preferable to control the impregnated layer's thickness in a range from 50 μm to 30 μm.

According to the present invention, the glass paste which is applied on surface areas in order to form the impregnated layer on the supporting plate consists of mainly $SiO_2$ with $Al_2O_3$, $B_2O_3$, BaO, PbO or the like. The glass having these ingredients is usually employed for forming the protective film for hybrid IC or the chip resistor. The glass paste can be prepared by mixing the aforementioned glass compositions with a terpineol-group solvent as a binder. With this mixture, the viscosity can be easily controlled, depending on the specific purposes. The glass compositions being impregnated into surfaces of the supporting plate contain high content of PbO in order to improve the wettability of the glass component, and besides the PbO, the glass compositions contain $SiO_2$, $Al_2O_3$, $Na_2O$,$K_2O$, or MgO.

According to the present invention, it is preferable to set the heat treatment conditions for the applied glass paste on the supporting plate surfaces as follows; a temperature ranging from 800° C. to 900° C. and a duration ranging from 10 minutes to 60 minutes.

EXAMPLE

Alumina raw powder having an average particle size of 20 μm was admixed to a sintering promoting agent and a binding agent. The thus obtained mixture was pressed to form a green body under the forming pressure of $0.3T/cm^2$. The pressed green was further sintered at 1,700° C. for 3 hours to produce the sintered alumina body with a porosity or 45%, and dimensions of 100 mm×100 mm×5 mm.

In the next step, after the both surfaces were grinding-polished in order to have the flatness of surfaces of said sintered, the glass paste ($\alpha=80\times10^{-7}$/° C., and To=600° C.) was applied on both surfaces with predetermined thickness by a screen print method. The alumina with painted glass paste was furthermore dried at 130° C. for 1 hours, followed by being heat-treated at 880° C. for 10 minutes to have the glass paste to melt and penetrate into the surface pores.

After the glass component (50%PbO-30%$SiO_2$-balanced with BaO and $B_2O_3$) was impregnated into the surface area of the sintered alumina, both surfaces were grinding-polished to have the flat surfaces to obtain the sintered product (with dimensions of 100 mm×100 mm×3 mm) having the glass compositions being impregnated to certain depths from the surfaces, as listed in Table I.

As for a supporting plate for producing the ceramic base plate which is a sintered body having the impregnated glass component as mentioned above, after the $Al_2O_3$—TiC system base plate with dimensions of 50 mm×20 mm×2 mm as a work-piece to be machined was wax-bonded to the supporting plate, it was fixed to the stage of the cutting machine through the vacuum-absorption.

Using the Metal Bond Blade SD#800 (trade name Reed Co., Ltd,) as a rotary cutting blade-with dimensions of 80 mm outer diameter×40 mm inner diameter×0.18 mm thickness, the cutting conditions were set as follows; a spindle revolution: 10 krpm, a whetstone blade feed speed: 100 mm/min, a cutting depth: 0.4 mm, and a cutting resistance: load on the spindle motor.

The whetstone blade cuts the work-piece of sintered alumina body while the whetstone blade is simultaneously dressed/sharpened by machining action of the supporting plate itself. Important parameters are listed in Table I. They include the glass impregnated layer depth, cutting resistance, wear loss of whetstone blade, vacuum-absorption attaching condition and wax-bonding condition. After the work-piece of sintered alumina body was wax-bonded to the supporting plate according to the present invention, the process efficiency was evaluated by the cutting resistance during cutting the supporting plate by the whetstone blade and cutting the alumina sintered by the whetstone blade. Moreover, the wear loss of the whetstone blade was obtained from the changes in the outer diameter of the rotary cutting blade before and after the machining the supporting plate.

TABLE I

| | Example | | | Comparison | |
|---|---|---|---|---|---|
| glass impregnated layer thickness (mm) | 60 | 200 | 280 | 0 | 500 |
| cutting resistance (W) | 104 | 110 | 115 | 90 | 150 |
| wear loss of whetstone blade (mm/m) | 60 | 54 | 50 | 65 | 33 |
| vacuum-absorption attaching condition | ○ | ○ | ○ | X | ○ |
| wax-bonding condition | ○ | ○ | ○ | X | ○ |

Comparison

For comparison, a supporting plate which was impregnated with the glass component to the depth of 500 μm on both surfaces of the sintered porous alumina body same as the Examples and a supporting plate made of sintered alumina body without any glass impregnation were employed. The work-piece of the sintered alumina body same as used for the Example was cut under the same conditions listed in Table I. The obtained data on the cutting resistance, wear loss of whetstone blade, vacuum-absorption attaching condition as well as wax-bonding condition were listed and compared in Table I.

While this invention has been explained in details with references to this process method, structure of the apparatus and process disclosed here, it should be understood that the invention is not limited to that precise examples; rather many modifications and variations would present themselves to those of skill in the art without departing from the scope and spirit of this invention, as defined in the appended claims.

What is claimed is:

1. A method of cutting a ceramic base plate using a rotary whetstone cutting blade while dressing and sharpening said blade, said method comprising the steps of: (a) providing a supporting plate comprising a sintered porous alumina substrate having a glass composition impregnated into opposite first and second surfaces thereof, (b) mounting said ceramic base plate on said first surface of said supporting plate, and (c) moving said rotary whetstone cutting blade toward and into said supporting plate and said ceramic base plate so as to cut into said supporting plate to dress and sharpen said blade and into said ceramic base plate to cut said ceramic base plate.

2. A method according to claim 1, wherein said ceramic base plate is smaller in size than said supporting plate in the direction of movement of said cutting blade so that in step (c) said rotating whetstone cutting blade first cuts into said supporting plate and then into both said supporting plate and said ceramic base plate simultaneously.

3. A method according to claim 2, wherein the supporting plate provided in step (a) is formed by coating said opposite sides of said porous alumina substrate with said glass composition and then heating said glass composition.

4. A method according to claim 3, wherein said glass composition comprises $SiO_2$, and at least one oxide selected from the group consisting of PbO, $Al_2O_3$, $B_2O_3$ and BaO.

5. A method according to claim 4, wherein said glass composition comprises 50 wt % PbO, 30 wt % $SiO_2$, and a balance of BaO and $B_2O_3$.

6. A method according to claim 2, wherein in step (b) said ceramic base plate is wax bonded to said supporting plate.

7. A method according to claim 2, wherein said sintered alumina substrate of the supporting plate provided in step (b) has a porosity of between 30 and 70%.

8. A method according to claim 3, wherein said glass composition is heated to between 800 and 900° C. for between 10 and 60 minutes.

9. A method according to claim 3, wherein the glass composition contains PbO and another oxide selected from the group consisting of $SiO_2$, $Al_2O_3$, $Na_2O$, $K_2O$ and MgO.

10. A method according to claim 1, including between steps (b) and (c) a step of fixing said supporting plate with ceramic base plate thereon to a stage of a cutting machine by vacuum absorption.

11. A method according to claim 1, wherein the glass composition is impregnated in the opposite surfaces of the sintered porous alumina substrate to a depth from 50 $\mu$m to 300 $\mu$m.

* * * * *